US007665921B2

(12) United States Patent
Liu

(10) Patent No.: US 7,665,921 B2
(45) Date of Patent: Feb. 23, 2010

(54) OFFSET PEN STRUCTURE FOR RAPID ASSEMBLING

(76) Inventor: Bao-Shen Liu, 1F, No. 65-1, Lane 3, Sec. 2, Daguan Rd., Banciao City, Taipei County 220 (TW)

( * ) Notice: Subject to any disclaimer, the term of this patent is extended or adjusted under 35 U.S.C. 154(b) by 382 days.

(21) Appl. No.: 11/555,188

(22) Filed: Oct. 31, 2006

(65) Prior Publication Data

US 2008/0101844 A1 May 1, 2008

(51) Int. Cl.
*A46B 5/02* (2006.01)
*B05C 1/00* (2006.01)

(52) U.S. Cl. ..... 401/6; 401/17

(58) Field of Classification Search ..... 401/6, 401/19–21, 28, 221, 17, 57
See application file for complete search history.

(56) References Cited

U.S. PATENT DOCUMENTS 5,599,853 A * 2/1997 Loftin ..... 523/160
5,791,798 A * 8/1998 Yu ..... 401/57
6,250,828 B1 * 6/2001 Liu ..... 401/6
D446,812 S * 8/2001 Liu ..... D19/43
6,328,494 B1 * 12/2001 Moxon ..... 401/8
2004/0076461 A1 * 4/2004 Liu ..... 401/17
2005/0152736 A1 * 7/2005 Liu et al. ..... 401/6

* cited by examiner

*Primary Examiner*—David J. Walczak
*Assistant Examiner*—Ryan A Varnum
(74) *Attorney, Agent, or Firm*—WPAT, P.C.; Anthony King; Kay Yang

(57) ABSTRACT

In an offset pen structure for rapid assembling, a holding portion is disposed, and an offset portion extends from the side at the front part of the holding portion, and a writing device base is disposed at the end of the offset portion, wherein the offset portion together with the holding portion has a hollow passage formed therein such that the hollow passage has an opening formed at the front end of the offset portion; the opening being used for mounting a recording device and covered by a lid; the writing device base is disposed at the front end of the lid; a fixing portion is disposed at the rear end of the lid, the fixing portion being fixed at the end of the offset portion to fix and position the writing device base on the holding portion; and further a cap is disposed on the writing device base to form a protection, with a clip disposed on the side thereof, the clip being used to be inserted into a pocket of the user for convenient carry.

19 Claims, 6 Drawing Sheets

OFFSET PEN STRUCTURE FOR RAPID ASSEMBLING

BACKGROUND OF THE INVENTION

1. Field of the Invention

The present invention relates to an offset pen structure and, particularly, to an offset pen structure for rapid assembling.

2. Description of the Prior Art

There are numerous classes of conventional offset pen structures, such as the offset pen of U.S. Pat. No. 6,250,828 (herein incorporated by reference in its entirety) owned by the inventor of this application. Such an offset pen is mainly characterized in that the way different parts of a pen is connected such that the offset pen has the holding portion and the writing portion thereof at different axes, for writing in a way more conforming to ergonomics.

However, the required structure causes the manufacturing of such offset pens to be relatively difficult and inconvenient, thus increases manufacturing cost so as to prevent popularization of the product. The main problems are:

1. The offset pen has the holding portion and the writing portion disposed at different axes, thus making it difficult to design a mold for it and, in turn making the shape of the product drab and unattractive to the consumers.

2. Similarly, a holding portion too drab may result in a design that is uncomfortable to hold and, thus, cannot bring the functions of the offset pen into play.

3. It is difficult to load refills or fillings for conventional offset pens. Such offset pens generally are made by first having soft refills placed into the holding portion from the rear end, then pressure is applied to the refills against the holding portion to deform the refills naturally. In addition to such difficult mounting process, maintaining the quality of the offset pen is also a problem.

4. It is not easy to replace the refills after the ink of the conventional offset pens is exhausted. Then the whole pen ceases to be effective, leading to a waste of resources.

It is thus shown that the conventional offset pens have such drawbacks and lacking in good design, such that an improvement is required.

In view of the above difficulties associated with the conventional offset pens, the present inventor, through long-term study and practice, has set about the work of improvement and innovation that provides an offset pen structure for rapid assembling.

SUMMARY OF THE INVENTION

The primary objective of this invention is to provide an offset pen structure for rapid assembling, wherein the offset pen is divided into several components or subparts as required, the components being shaped with simple design and can be easily produced so as to decrease manufacturing cost.

Another objective of this invention is to provide an offset pen structure for rapid assembling, wherein the components are easy to disassemble and assemble so as to have convenient maintenance and replacement, improving usability of the product and reduce wasting of resources.

A further objective of this invention is to provide an offset pen structure for rapid assembling that, by a clever design, requires adjusting a small number of components only to have the useful functions of various recording devices provided by a single holding portion.

Yet a further objective of this invention is to provide an offset pen structure for rapid assembling that has each individual component with enhanced shaping design so as to provide a overall beautiful appearance and unparalleled style to the pen as a whole.

In an offset pen structure for rapid assembling that fulfills the above objectives, a holding portion is disposed, and an offset portion extends from the side at the front part of the holding portion, and a writing device base is disposed at the end of the offset portion, wherein the offset portion together with the holding portion has a hollow passage formed therein such that the hollow passage has an opening formed at the front end of the offset portion; the opening being used for mounting a recording device and covered by a lid; the writing device base is disposed at the front end of the lid, to fix the front end of the recording device for writing; a fixing portion is disposed at the rear end of the lid, the fixing portion being fixed at the end of the offset portion to fix and position the writing device base on the holding portion; the fixing portion has a trough disposed on the edge thereof, for lodging and fixing a case surface of the offset portion; the fixing portion has a thread disposed on the inner side thereof and the writing device base has a thread disposed at the rear end thereof, so that the writing device base may wear the lid and then be screwed at the fixing portion; and further a cap is disposed on the writing device base to form a protection, with a clip disposed on the side thereof. The clip can be used when the pen is inserted into a pocket of a user for attachment to the pocket. The clip is shaped in an angle to correlate with the shape and angle of the offset pen.

BRIEF DESCRIPTION OF THE DRAWINGS

The drawings disclose an illustrative embodiment of the present invention, which serves to exemplify the various advantages and objects hereof, and are as follows.

DETAILED DESCRIPTION OF THE PREFERRED EMBODIMENT

Figure 1:
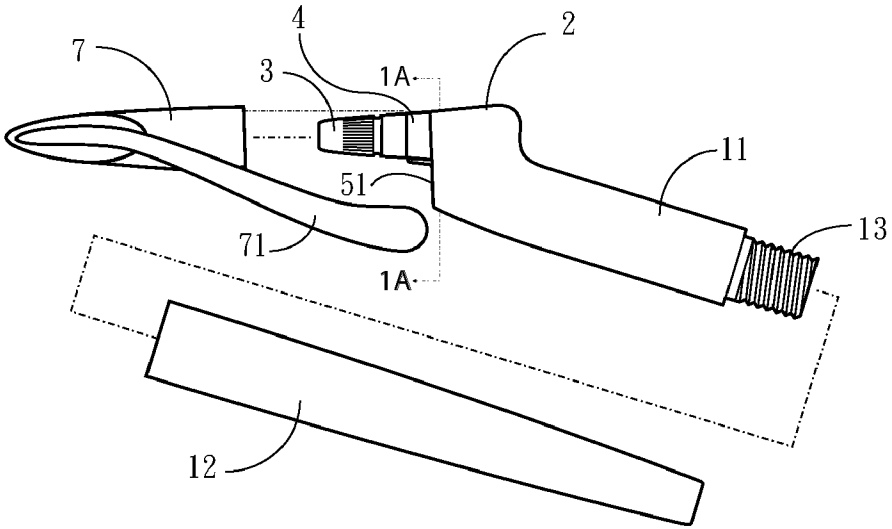
FIG. 1 is a diagram of an embodiment of the offset pen structure for rapid assembling of the present invention.
Figure 1C:
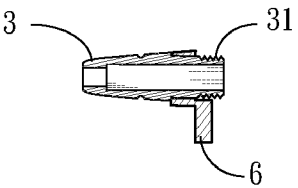
FIG. 1C is a structurally composite broken away view of the writing device base of the present invention.
Figure 1A:
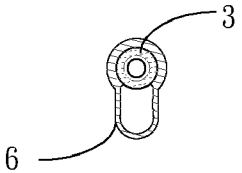
FIG. 1A is a cross-sectional view of the invention along section 1A-1A of FIG. 1.
Figure 1B:
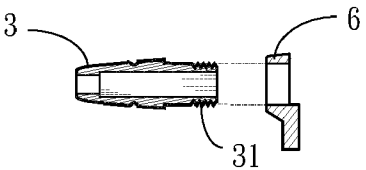
FIG. 1B is a structurally exploded broken away view of the writing device base of the present invention.

Refer to FIG. 1 to 1C, which is the offset pen structure for rapid assembling provided by the present invention, the offset pen structure for rapid assembling mainly comprises a holding portion 1, a writing device base 3, and an offset portion 2, wherein the holding portion 1 is used for holding and operating by the user with a hand; the writing device base 3 has recording devices 9*a*, 9*b* (described below) disposed therein for writing; the offset portion 2 is connected between the front end of the holding portion 1 and the rear end of the writing device base 3 so as to make the writing device base 3 and the holding portion 1 disposed respectively at different axes. The offset portion 2 described above has a fixing portion 4 disposed at the front end thereof, for positioning the writing device base 3 by means of screwing, wearing, locking, or the like. The present invention is mainly characterized in that the writing device base 3 has a thread 31 disposed at the tail thereof so as to be screwed and fixed on the fixing portion 4 by the thread 31. The holding portion 1 and the offset portion 2 described above has a hollow passage 5 (refer to FIG. 6B) formed and penetrating therein, the hollow passage 5 forming an opening 51 at the front end of the offset portion 2, for mounting the recording devices 9*a*, 9*b* via the opening 51 as well as for facilitating molding and manufacturing. An optional lid 6, if desired, may be disposed to cover the opening 51, and the writing device base 3 wears the lid to be fixed on the offset portion 2. Moreover, the holding portion is made to be two-sectioned, such that the sections 11, 12 thereof each have a draft angle that is easy to finish and manufacture; if desired, soft recording devices may be adopted, being placed into the hollow passage 5 via a sectioned point 13 to accomplish the assembly, or other devices may be accommodated in the hollow passage 5. Furthermore, the writing device base 3 has a cap 7 disposed thereon to form a protection, the cap 7 having a clip 71 disposed on the side thereof, the clip being used to be inserted into a pocket and secure to the pocket of the user for convenient carrying, and the clip 71 being turned and bent according and correlate to the shape of the offset pen to make a more beautiful appearance for the offset pen as a whole; the clip 71 can be separately manufactured with respect to the cap 7, and then put onto the cap 7 to form as one piece.

Figure 2:
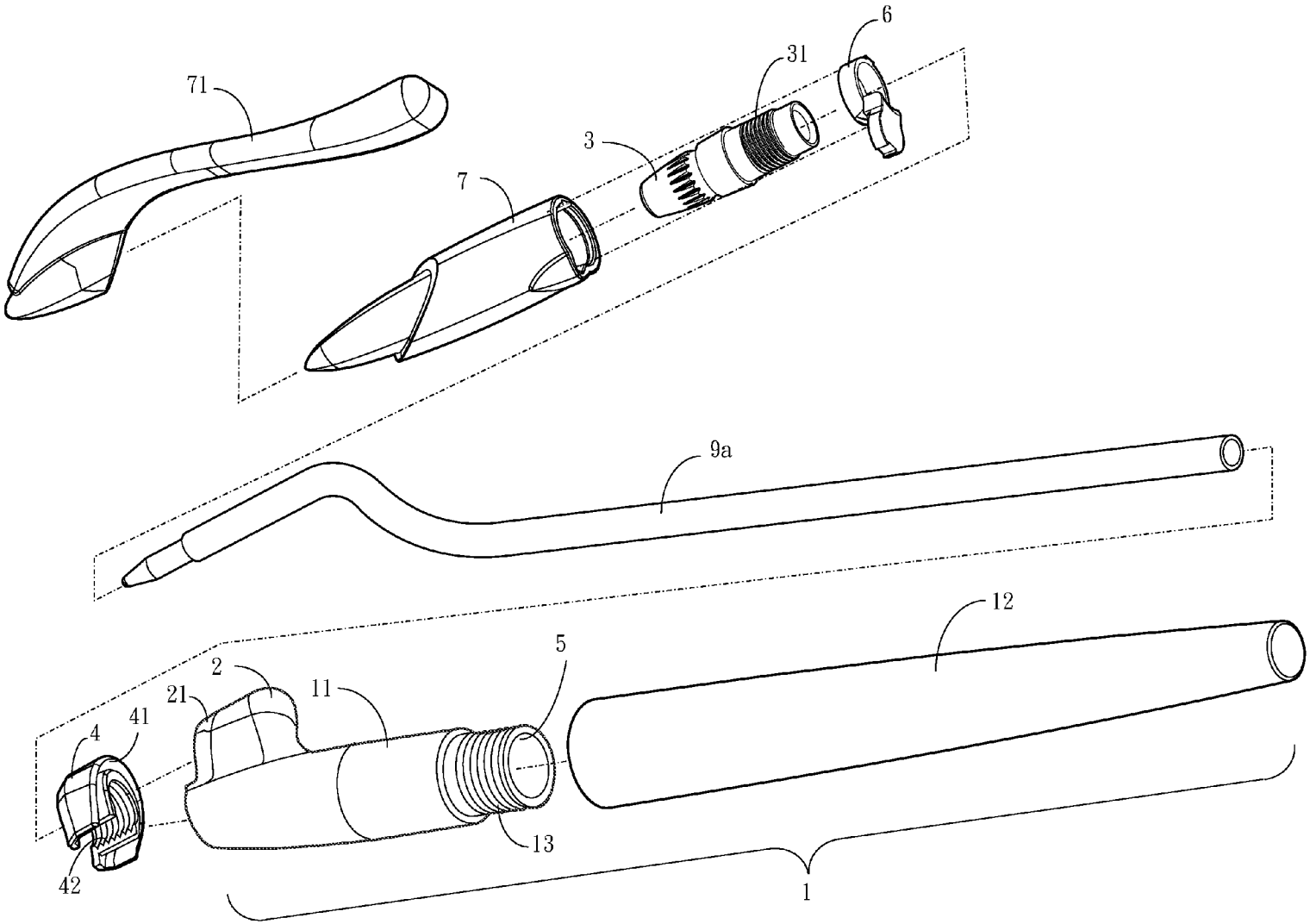
FIG. 2 is an exploded solid top view of another embodiment of the offset pen structure for rapid assembling of the present invention.
Figure 3:
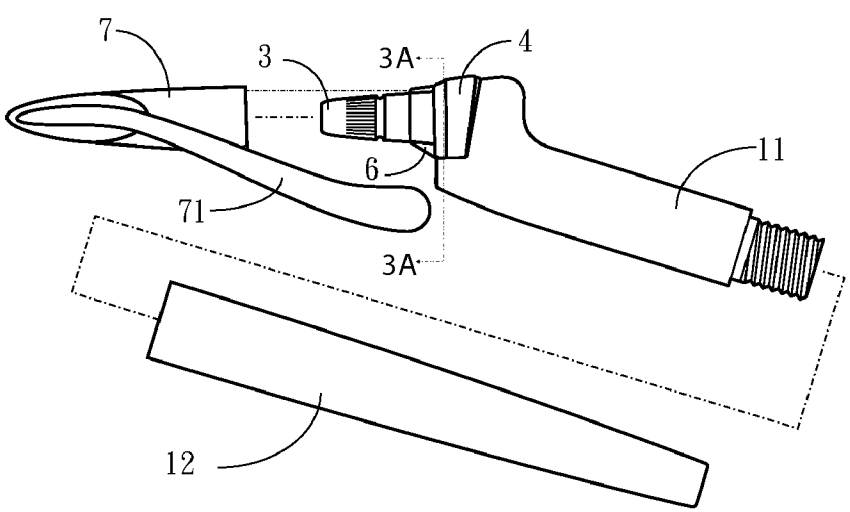
FIG. 3 is a structurally exploded view for FIG. 2.
Figure 3A:
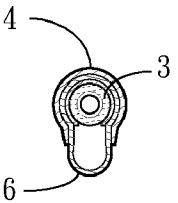
FIG. 3A is a cross-sectional view of the invention along section 3A-3A of FIG. 3.
Figure 3E:
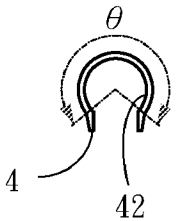
FIG. 3E is a diagram of the disposed angle of the thread in FIG. 2.
Figure 3D:
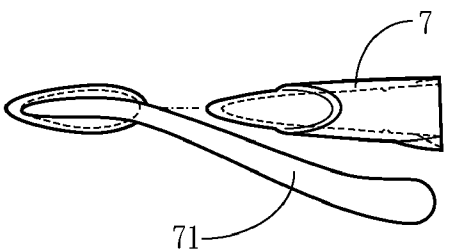
FIG. 3D is a structurally exploded view of the cap in FIG. 2.
Figure 3C:
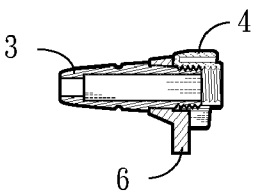
FIG. 3C is a structurally composite broken away view of the writing device of FIG. 2.
Figure 3B:
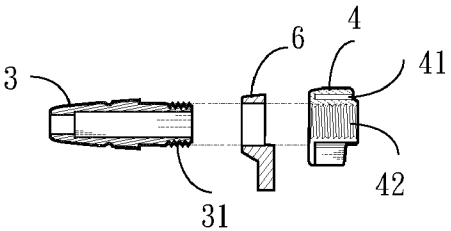
FIG. 3B is a structurally exploded broken away view of the writing device of FIG. 2
Figure 4:
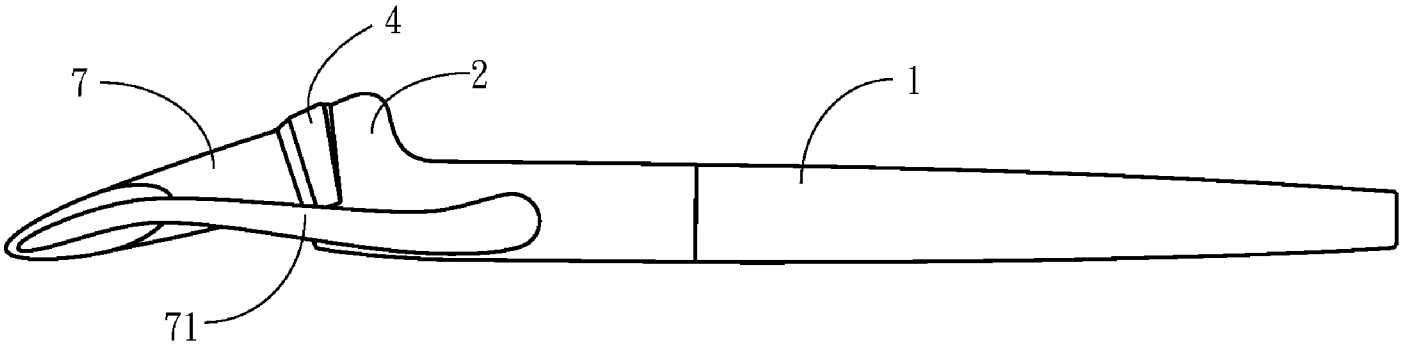
FIG. 4 is a top view view of the present invention.

Refer to FIGS. 2 to 4. The offset portion 2 may have the fixing portion 4 one-piece molded and, also, may have the fixing portion 4 molded separately to make the assembly units each having a simplistic design. The fixing portion 4 has a trough 41 formed at the edge of one end thereof, and the offset portion 2 has a thinned case surface 21 formed at the front end thereof to be lodged and fixed in the trough 41. The fixing portion 4 has a thread 42 disposed on the inner side thereof so that the writing device base 3 may wear the lid 6 to be screwed in the fixing portion 4 by the thread 31. Since the thread 42 is disposed on the fixing portion 4 and not on the holding portion 1 as designed, such design would not increase difficulty in manufacturing of the holding portion 1. Moreover, as shown in FIG. 3E, the fixing portion 4 shows a U-shape, having the thread 42 disposed on the inner side thereof with a desired disposed angle θ larger than 180° so as to prevent the writing device base 3 from falling from the U-shape opening. Furthermore, the opening 51 may be used for mounting the ink-reservoir type recording device 9*a*, the ink-reservoir type recording device 9*a* having one end shaped to be turned and bent corresponding to the shape of the offset pen, with the front end thereof fixed at the writing device base 3, and can be placed into the hollow passage 5 of the holding portion 1 via the opening 51, and then can be screwed and fixed at the writing device base 3. The opening 51 may then be covered by the lid 6.

By the design described above, the offset pen are made up of subparts of simplistic design, and may be disassembled. The simplistically shaped design allows the holding portion 1, writing device base 3, and the cap 7, to be more conveniently finished and assembled. Each subparts is can be replaced with a replacement component, or it may be replace with component having a different aesthetic design or shape.

Figure 5:
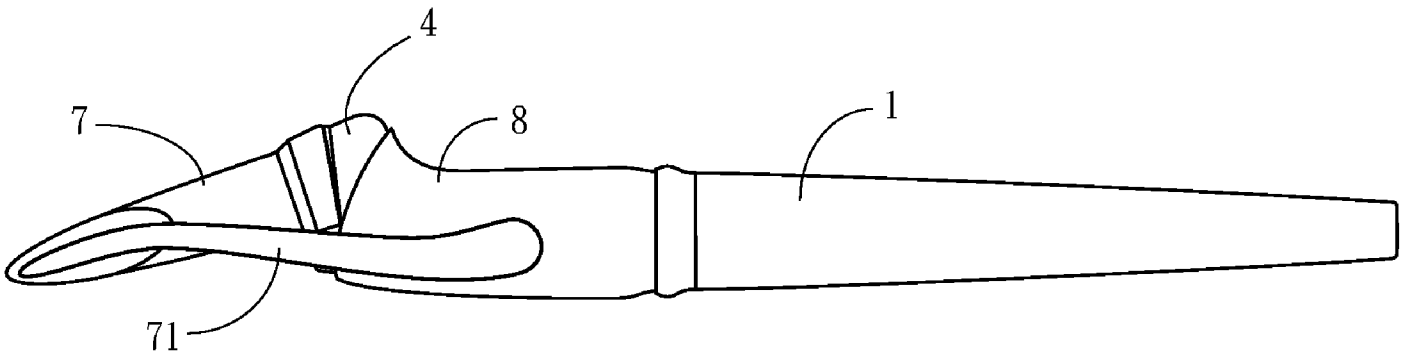
FIG. 5 is a top view of an embodiment of the present invention having an additional sleeve.

Refer to FIG. 5, which shows that the holding portion 1 may have a polygonal holding sleeve 8 disposed at a position thereof corresponding to hand of the user, for positioning the hand and reducing the fatigue of the fingers, and to prevent associated injuries.

Figure 6:
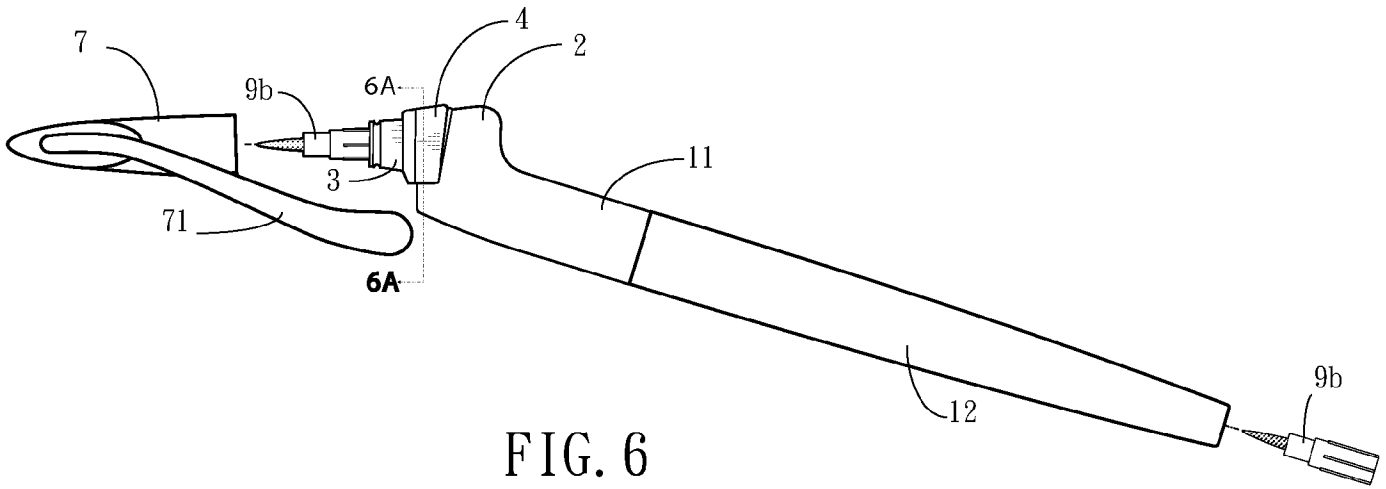
FIG. 6 is a top view of the pencil in an embodiment of the offset pen structure for rapid assembling of the present invention.
Figure 6A:
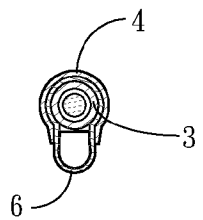
FIG. 6A is a cross-sectional view of the invention along section 6A-6A of FIG. 6.
Figure 6B:
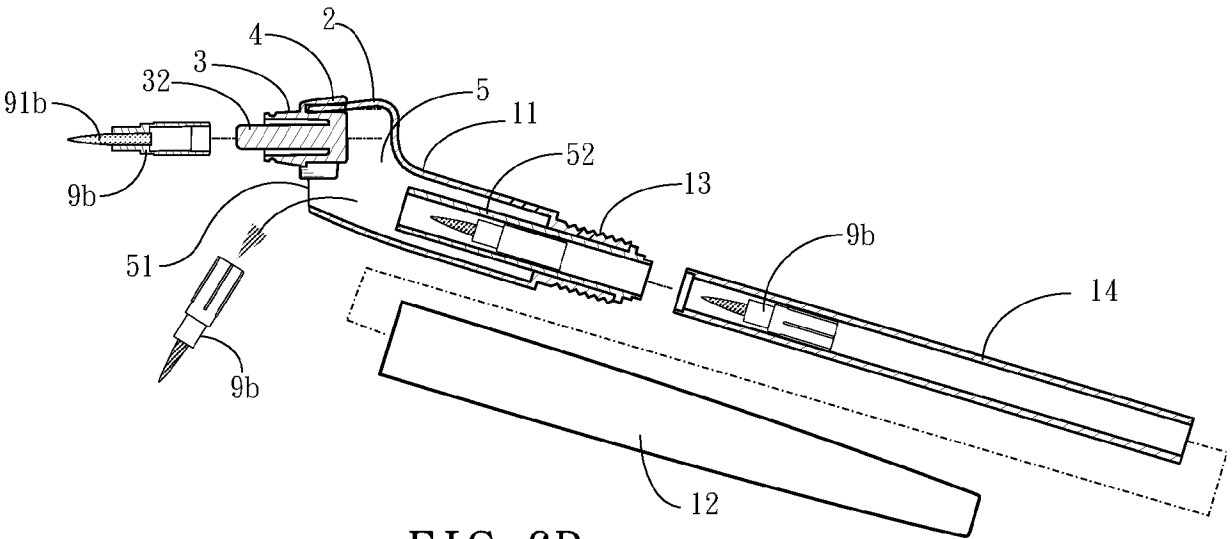
FIG. 6B is a structurally composite broken away view of the writing device base of the pencil in an embodiment of the present invention shown in FIG. 6.

Refer to FIG. 6 to 6B. A design of the pencil type recording device 9*b* is described with a fixing pin 32 disposed on the writing device base 3, wherein the fixing pin 32 secures the positions of the pencil type recording device 9*b* and, also, keeps the pencil lead 91*b* from being drawn back into the pencil type recording device 9*b*, so that one may comfortably apply force when writing; spare pencil type recording devices 9*b* may be placed into the hollow passage 5 via the sectioned point 13. Alternatively, the hollow passage 5 of the holding portion 1 may have an accommodating pipe 14 mounted therein for accommodating multiple sectioned recording devices 9*b*. And, the hollow passage 5 of the offset portion 2 may have a corresponding guiding pipe 52 mounted therein for sticking and fixing the accommodating pipe 14 at the tail of the guiding pipe 52, so that replacement of the pencil type recording device 9*b* may be performed at the section 12 at the rear end of the holding portion 1 while the pencil type recording device 9*b* in the front end of the pen may fall out of the offset portion 2 via the opening 51 at the front end of the hollow passage 5. As a result, the pencil type recording device 9*b* is positioned and pinned within the fixing pin 32 ready for use.

Figure 7A:
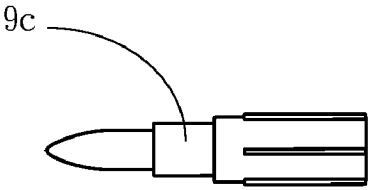
FIG. 7A is a top view of the solid recording device of the present invention.
Figure 7B:
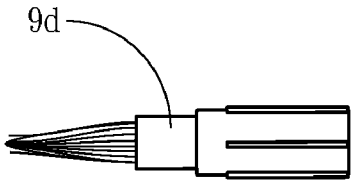
FIG. 7B is a top view of the dipping recording device of the present invention.
Figure 7C:
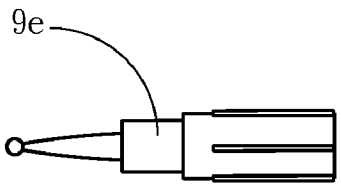
FIG. 7C is a top view of the recording device as a sharp metal object.
Figure 7D:
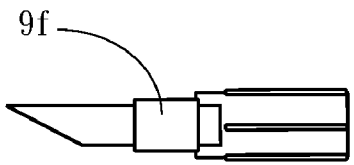
FIG. 7D is a top view of the recording device as a burin.

Refer to FIG. 7A to 7B, which show that the present invention may adopt various types of recording devices. Regarding the shape, the present invention may adopt a bar-shaped recording device such as the recording device 9*a* described above, or adopt a sectioned recording device such as the recording device 9*b* described above. Regarding the function, the present invention may adopt a recording device containing ink such as the recording device 9*a* described above, or adopt a refill having a ballpoint and an oil-based ink reservoir, a refill having a ballpoint and a neutral ink reservoir, a refill having a ballpoint and a water-based ink reservoir, a refill having a ballpoint and an erasable neutral ink reservoir, or a refill having a ballpoint and an erasable oil-based ink reservoir; the present invention may also adopt a solid recording device for marking, such as the recording device 9*a* described above, or adopt the recording device 9*c* as shown in FIG. 7A, e.g., a pencil lead, a crayon stick, or a oil pastel chalk; the present invention may also adopt the recording device 9*d* for dipping ink or color powder as shown in FIG. 7B, e.g., a fibrous refill, a fibrous hair, and an animal hair. The present invention may even adopt the recording device 9*e*, 9*f* for performing destructive recording by pressing or carving as shown in FIGS. 7C and D, e.g., a sharp metal object, or a burin. Of course, other known recording, writing, or erasing devices not mentioned here may be obvious and can be used.

Many changes and modifications in the above-described embodiment of the invention can, of course, be carried out without departing from the scope thereof. Accordingly, to promote the progress in science and the useful arts, the invention is disclosed and is limited only by the scope of the appended claims.

What is claimed is:

1. An offset pen structure for rapid assembling, comprising:

a holding portion, for being held and operated by the user with a hand;

a writing device base, showing a hollow shape, with recording devices disposed therewithin for recording a mark; and an offset portion, connected between a front end of the holding portion and a rear end of the writing device base so as to make the writing device base and the holding portion disposed respectively at different axes, wherein the holding portion has a hollow passage formed therein for accommodating the recording devices, such that the hollow passage extends and penetrates the offset portion and forms an opening at a front end of the offset portion; and the offset portion has a fixing portion disposed at the front end thereof, for positioning the writing device base and the recording devices by means of screwing, wearing, or locking, wherein the fixing portion shows a U-shape, with a thread disposed on an inner side thereof and having a disposed angle larger than 180° so as to prevent the writing device base from falling from the opening.

2. The offset pen structure for rapid assembling of claim 1, wherein the offset portion has the fixing portion one-piece molded at the front end thereof.

3. The offset pen structure for rapid assembling of claim 1, wherein the offset portion has the fixing portion molded separately, the fixing portion has a trough formed at one end thereof, and the offset portion has a case surface formed at the front end thereof to be lodged and fixed in the trough of the fixing portion.

4. The offset pen structure for rapid assembling of claim 1, wherein the opening is covered by a lid disposed thereon, and the writing device base wears the lid to be fixed in the fixing portion of the offset portion.

5. The offset pen structure for rapid assembling of claim 1, wherein the recording device is a bar recording device.

6. The offset pen structure for rapid assembling of claim 5, wherein the recording device has one end shaped to be turned and bent, with the front end thereof fixed at the writing device base, and is placed into the hollow passage of the offset portion and of the holding portion via the opening.

7. The offset pen structure for rapid assembling of claim 1, wherein the recording device is a sectioned recording device.

8. The offset pen structure for rapid assembling of claim 7, wherein the writing device base has a fixing pin disposed therein so as to facilitate sticking the sectioned recording device at the fixing pin for use.

9. The offset pen structure for rapid assembling of claim 7, wherein the hollow passage of the holding portion has an accommodating pipe mounted therein for accommodating multiple sectioned recording devices, and the hollow passage of the offset portion has a corresponding guiding pipe mounted therein for sticking and fixing the accommodating pipes at the tail of the guiding pipe.

10. The offset pen structure for rapid assembling of claim 7, wherein the recording device is a recording device containing ink, being selected from the group consisting of a refill having a ballpoint and an oil-based ink reservoir, a refill having a ballpoint and a neutral ink reservoir, a refill having a ballpoint and a water-based ink reservoir, a refill having a ballpoint and an erasable neutral ink reservoir, and a refill having a ballpoint and an erasable oil-based ink reservoir.

11. The offset pen structure for rapid assembling of claim 7, wherein the recording device is a solid recording device for marking, being selected from the group consisting of a pencil lead, a crayon stick, and a oil pastel chalk.

12. The offset pen structure for rapid assembling of claim 7, wherein the recording device is a dipping recording device, being selected from the group consisting of a fibrous refill, a fibrous hair, and an animal hair.

13. The offset pen structure for rapid assembling of claim 7, wherein the recording device is a recording device selected from the group consisting of a sharp metal object, and a burin.

14. The offset pen structure for rapid assembling of claim 1, wherein the holding portion is two-sectioned, allowing the recording device or other devices to be placed in from a sectioned point of the holding portion.

15. The offset pen structure for rapid assembling of claim 1, wherein the holding portion has a holding sleeve disposed at a position thereof corresponding to a hand of the user, for enhancing the comfortableness.

16. The offset pen structure for rapid assembling of claim 15, wherein the holding sleeve is geometrically shaped so as to be triangular or polygonal.

17. The offset pen structure for rapid assembling of claim 1, wherein the writing device base allows a cap to cover from the outside thereof, the cap having a clip disposed on the side thereof.

18. The offset pen structure for rapid assembling of claim 17, wherein the clip is turned and bent according to the shaping of the offset pen.

19. The offset pen structure for rapid assembling of claim 17, wherein the clip is separately finished with respect to the cap, and then put onto the cap to form as one piece.

* * * * *